US011399604B2

(12) United States Patent
Martini

(10) Patent No.: US 11,399,604 B2
(45) Date of Patent: Aug. 2, 2022

(54) SYSTEM FOR STORAGE OF COMPRESSIBLE WRINKLE RESISTANT GARMENTS IN REDUCED VOLUME

(71) Applicant: Ashley M. Martini, Boca Raton, FL (US)

(72) Inventor: Ashley M. Martini, Boca Raton, FL (US)

(73) Assignee: FASHION IP, LLC, Boca Raton, FL (US)

( * ) Notice: Subject to any disclaimer, the term of this patent is extended or adjusted under 35 U.S.C. 154(b) by 344 days.

(21) Appl. No.: 16/806,181

(22) Filed: Mar. 2, 2020

(65) Prior Publication Data

US 2020/0196721 A1 Jun. 25, 2020

Related U.S. Application Data

(63) Continuation-in-part of application No. 16/740,886, filed on Jan. 13, 2020, now abandoned, and a continuation-in-part of application No. 14/816,875, filed on Aug. 3, 2015, now abandoned.

(51) Int. Cl.

| | |
|---|---|
| ***A45C 3/00*** | (2006.01) |
| ***A45C 13/03*** | (2006.01) |
| ***A45C 13/00*** | (2006.01) |

(52) U.S. Cl.

CPC ..... *A45C 3/004* (2013.01); *A45C 13/008* (2013.01); *A45C 13/03* (2013.01)

(58) Field of Classification Search

CPC ..... A45C 3/004; A45C 13/008; A45C 13/03

See application file for complete search history.

(56) References Cited

U.S. PATENT DOCUMENTS

| | | | | |
|---|---|---|---|---|
| 6,499,600 | B2 * | 12/2002 | Koyanagi | B65D 33/01 206/524.8 |
| 7,775,351 | B2 * | 8/2010 | Stagnitta | B65B 63/02 206/278 |
| 2002/0162767 | A1 * | 11/2002 | Ohtsubo | B65D 81/203 206/524.8 |
| 2004/0057636 | A1 * | 3/2004 | Ishizaki | B65D 81/2038 383/44 |
| 2008/0159661 | A1 * | 7/2008 | Kim | B65D 33/04 383/61.3 |

* cited by examiner

*Primary Examiner* — Tri M Mai

(74) *Attorney, Agent, or Firm* — Melvin K. Silverman

(57) ABSTRACT

A kit and a method of providing a kit for compact storage and maximum portability of a reusable compressible dress intended for emergency use, wherein the kit includes a wrinkle-resistant polymeric fabric dress, a pouch formed of a flexible, waterproof, tear-resistant material, including means for selectable opening and closure of a longitudinal opening thereof, wherein the dress is capable of selectable folding and compression to less than the volume of the pouch and which is press-or slip-fittable thereinto, and the kit includes a reclosable sealable plastic zip-top bag for receiving soiled garments, separate from that of the pouch.

10 Claims, 7 Drawing Sheets

SYSTEM FOR STORAGE OF COMPRESSIBLE WRINKLE RESISTANT GARMENTS IN REDUCED VOLUME

REFERENCE TO RELATED APPLICATION

This application claims the benefit under 35 USC 120 of a co-pending patent application Ser. No. 16/740,886, filed Jan. 13, 2020, which application claims the benefit of patent application Ser. No. 14/816,875, filed Aug. 3, 2015, which claims the benefit under 35 USC 119(e) of provisional patent Application Ser. No. 62/032,198, filed Aug. 1, 2014, all of which are herein incorporated by reference in their entirety.

BACKGROUND OF THE INVENTION

Current systems of clothing storage and transportation involve use of a garment bag, such as the one shown in U.S. Pat. No. 2,329,620, that places a generic article of clothing, of any type of fabric, and closing the garment bag for transportation. Further apparel bags include U.S. Pat. No. 3,945,415, which allows a shirt to be folded and placed in a bag designed to minimize shifting of the shirt within a luggage, but does not address the ability to compress into a smaller volume, or the use of a specialized article of clothing to avoid wrinkles. Other systems offer vacuum sealing of a garment in luggage, U.S. Pat. No. 6,499,574 B1, but this requires that the garment be vacuum sealed each time for transportation. In each of these systems currently in the market, the container is merely for transporting a generic garment, and does not distinguish between materials, thus cannot be configured to be used in the same manner as the invention herein.

Further, to the knowledge of the within inventor, there currently exist no garments or dresses that are made of a specifically selected material and construction to optimize said dress for compressibility, long term storage without wrinkling, and minimal volume requirements, as most dresses focus solely on aesthetics over function.

However, each of these inventions, whether taken individually or as a whole, still do not solve the problem the kit herein provides a solution for. That is, a solution does not exist for a kit including a specialized wrinkle resistant dress, constructed of material selected for its wrinkle resistance, low volume, and compressibility, nor do any of these containers provide the necessary structure necessary for compression and protection of clothing in a small form factor.

The design of such a system is not a simple matter of folding a nylon, nylon-SPANDEX or Lycra-like garment into a small plastic pouch. Rather, there are many factors which must be considered in the development of such a system, particularly where air travel is a consideration and system of the present type is checked as luggage or when the garment contained in the pouch of the system is stored within an automobile in which high temperatures can be reached.

To the knowledge of the within inventor, systems for compressive storage of particular garments of clothing intended for emergency use and the like, in the manner set forth herein, are not known in the art.

SUMMARY OF THE INVENTION

The present invention provides a kit for compact storage and maximum portability of a reusable compressible dress intended for emergency use, including a pouch formed of a flexible, waterproof, tear-resistant material having a volume in the range of 400 to 1000 cubic centimeters, the pouch including means for selectable opening and closure of a longitudinal opening thereof, and includes a reclosable sealable plastic zip-top bag for receiving soiled garments, separate from that of the pouch.

The kit further includes a compressible dress, constructed of fabric configured to resist wrinkles cause by compression for an extended period of time, wherein said fabric is in a weight range of up to 450 grams, having a thickness in the range of 0.35 mm to 0.55 mm, thereby allowing said compressible dress to be optimally folded for a reduced volume, wherein the wrinkle-resistant fabric capable of selectable folding and compression to less than said volume of said pouch and, thereupon, press- or slip-fittable thereinto, and the fabric of said compressible dress is capable of expansion of at least 200% in size upon removal from said pouch, wherein said expansion does not result in a sheer or see-through material, and said fabric is capable of returning to its original physical condition after expansion; and The invention also includes a method for providing a kit for compact storage and maximum portability of a reusable compressible dress intended for emergency use, with the steps of: 1) providing a pouch wherein said pouch is selected from a material having a flexible, waterproof, tear-resistant material having a volume in the range of 400 to 1000 cubic centimeters, the pouch including means for selectable opening and closure of a longitudinal opening thereof, 2) providing a compressible dress, wherein said providing of said compressible dress further includes constructing said dress of fabric configured to resist wrinkles cause by compression for an extended period of time, wherein said fabric is in a weight range of up to 450 grams, having a thickness in the range of 0.35 mm to 0.55 mm, thereby allowing said compressible dress to be optimally folded for a reduced volume, wherein said wrinkle-resistant fabric is capable of selectable folding and compression to less than said volume of said pouch and, thereupon, press- or slip-fittable thereinto, and said fabric of said compressible dress is capable of expansion of at least 200% in size upon removal from said pouch, wherein said expansion does not result in a sheer or see-through material, and said fabric is capable of returning to its original physical condition after expansion, 3) folding and including a reclosable sealable plastic zip-top bag inside said pouch for receiving soiled garments, separate from that of said pouch, 4) folding said compressible dress into segments that mirror width and length dimensions of said pouch to avoid gaps and air pockets between the compressible dress and pouch when said dress is slipped into said pouch, and 5) inserting said compressed dress into said longitudinal opening.

It is an object of the invention to provide a protective system for the storage of staple articles of clothing in a compressed space for an extended period of time.

It is another object to provide a system of the above type in which the stored article, when unpacked, will readily return to its original condition.

It is a further object to provide a system of the above type that will protect the article of clothing from conditions of heat, cold, moisture, physical impact and polymeric interaction with the pouch of the system.

The above any yet other objects and advantages of the present system will become apparent from the hereinafter set forth Brief Description of the Drawings, Detailed Description of the Invention, and Claims appended herewith.

DETAILED DESCRIPTION OF THE INVENTION

The present invention disclosed herein is a kit for compact storage and maximum portability of a reusable compressible dress intended for emergency use, the kit comprising a pouch formed of a flexible, waterproof, tear-resistant material having a volume in the range of 400 to 1000 cubic centimeters, the pouch including means for selectable opening and closure of a longitudinal opening thereof.

Figure 1:
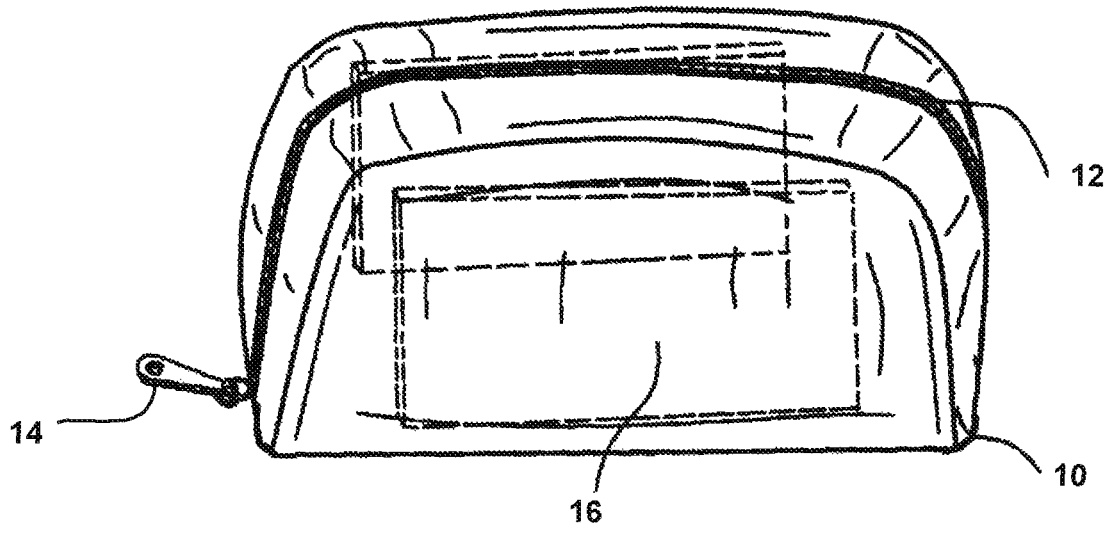
FIG. 1 is a side view of the exterior of the pouch of the kit, with panels shown in phantom.
Figure 2:
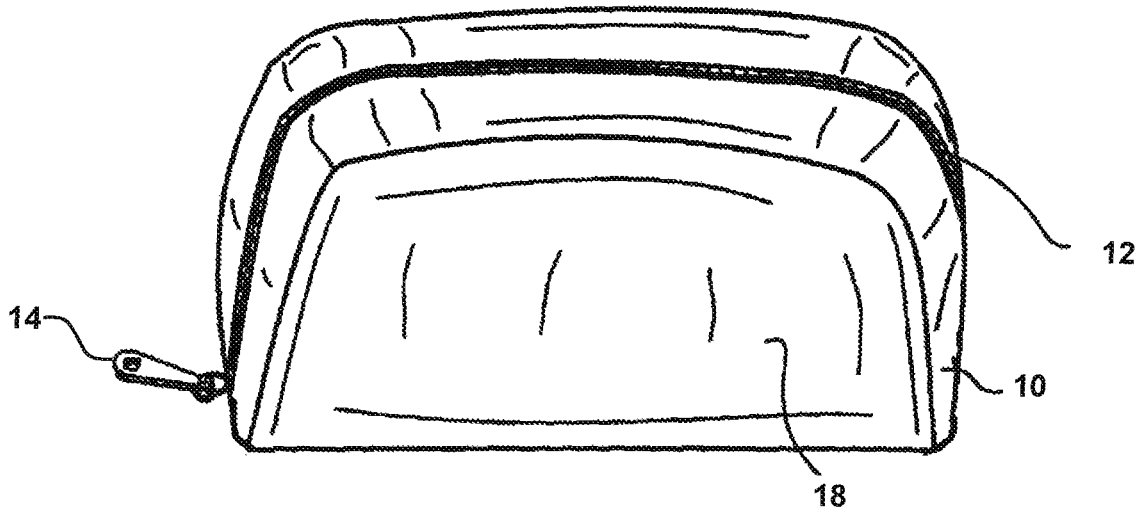
FIG. 2 is a side view similar to that of FIG. 1.
Figure 3:
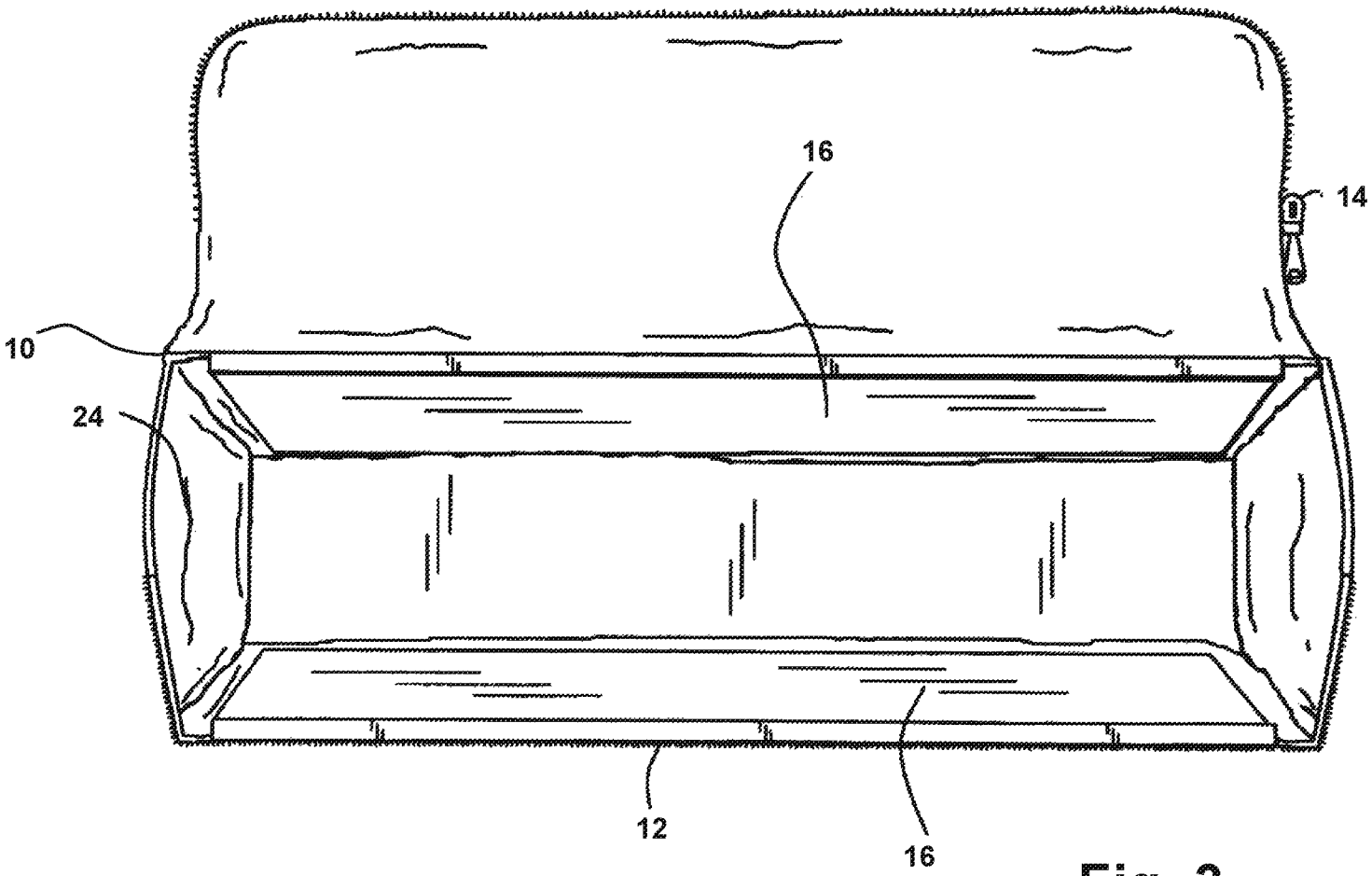
FIG. 3 is a top view of the pouch.
Figure 4:
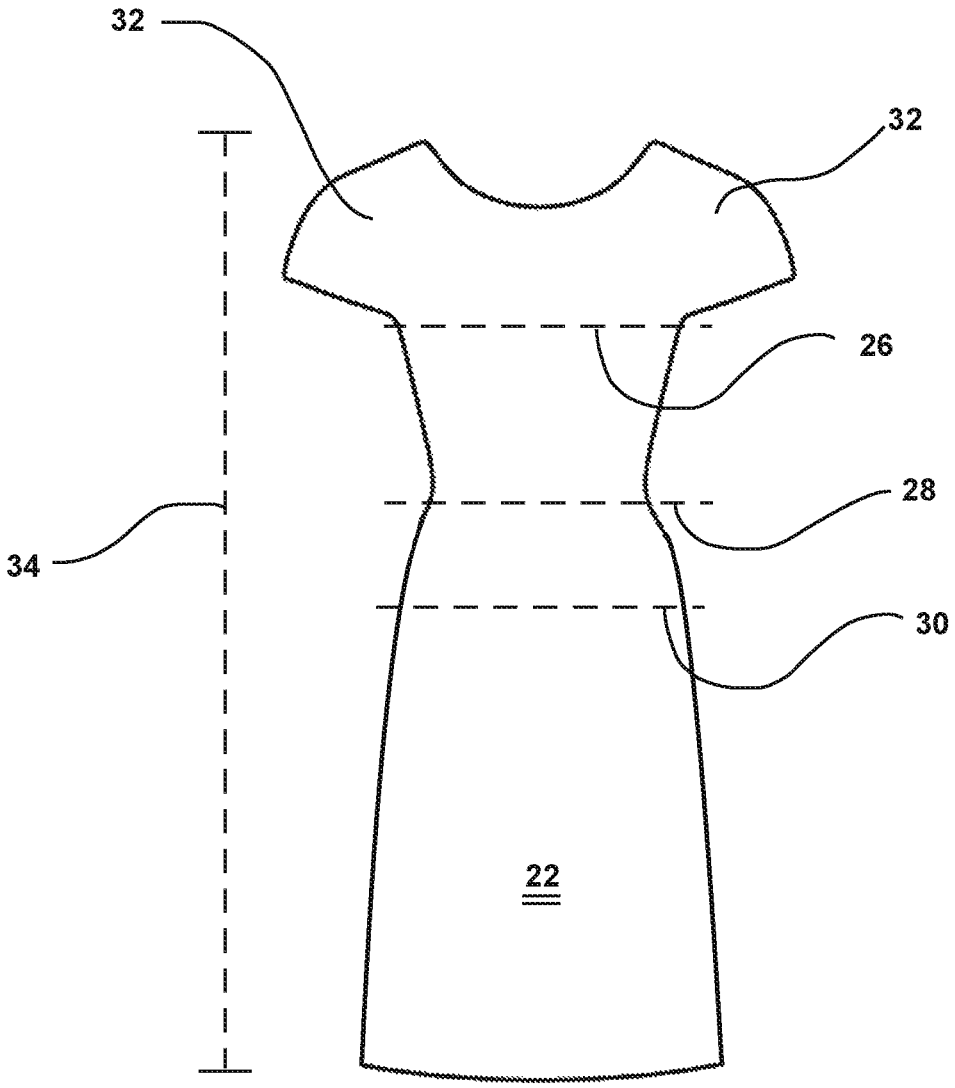
FIG. 4 is a front view of the dress of the kit.
Figure 5:
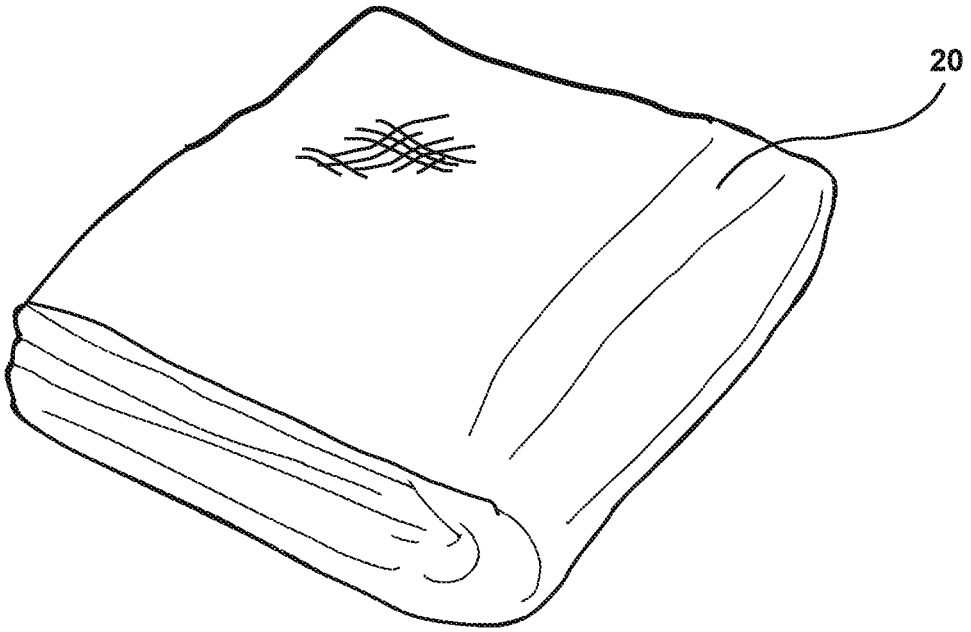
FIG. 5 is a perspective view of the dress folded.
Figure 6:
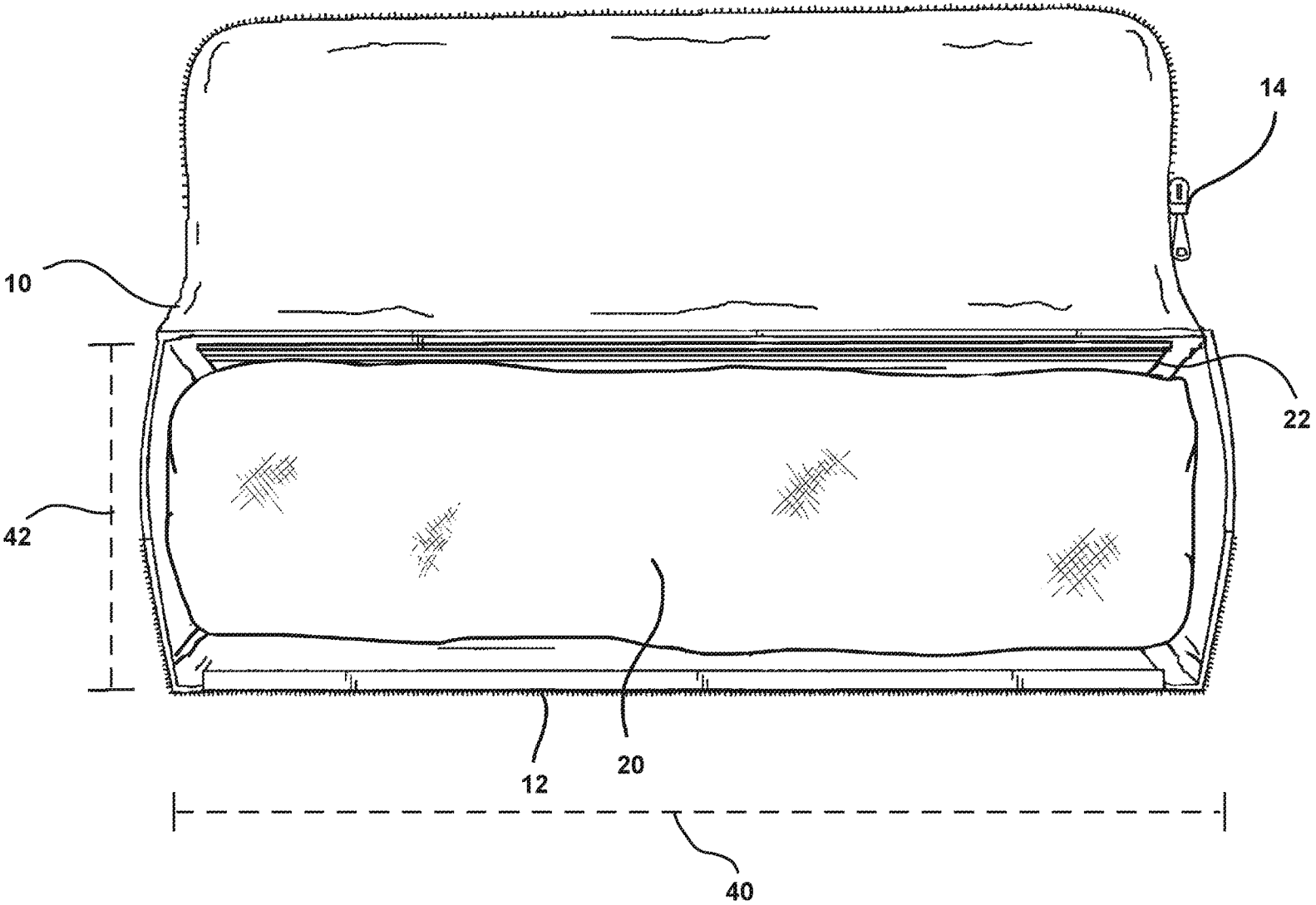
FIG. 6 is a top view similar to that of FIG. 3, showing the compressed dress and zip-top bag.
Figure 7:
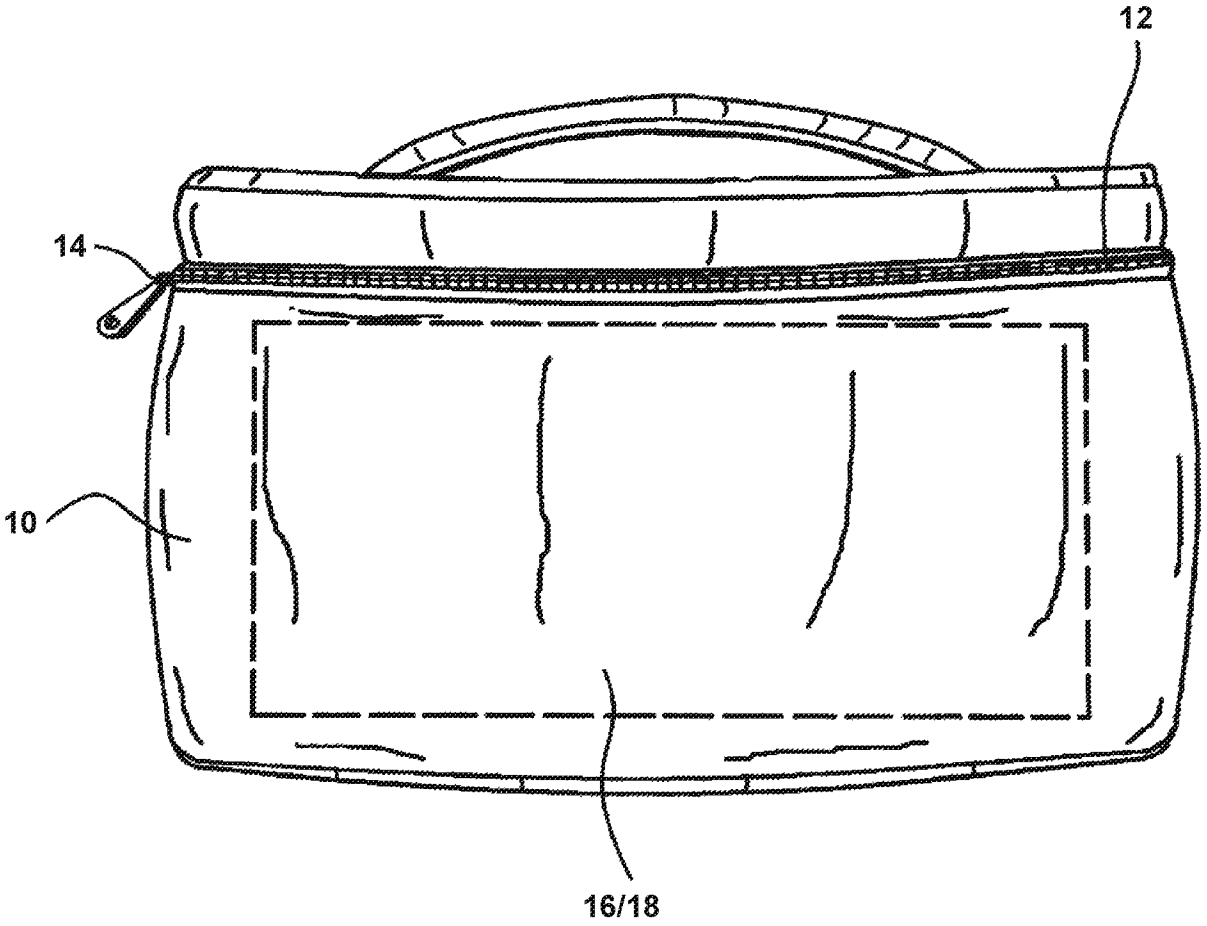
FIG. 7 is another view of the kit, with panels shown in phantom.
Figure 8:
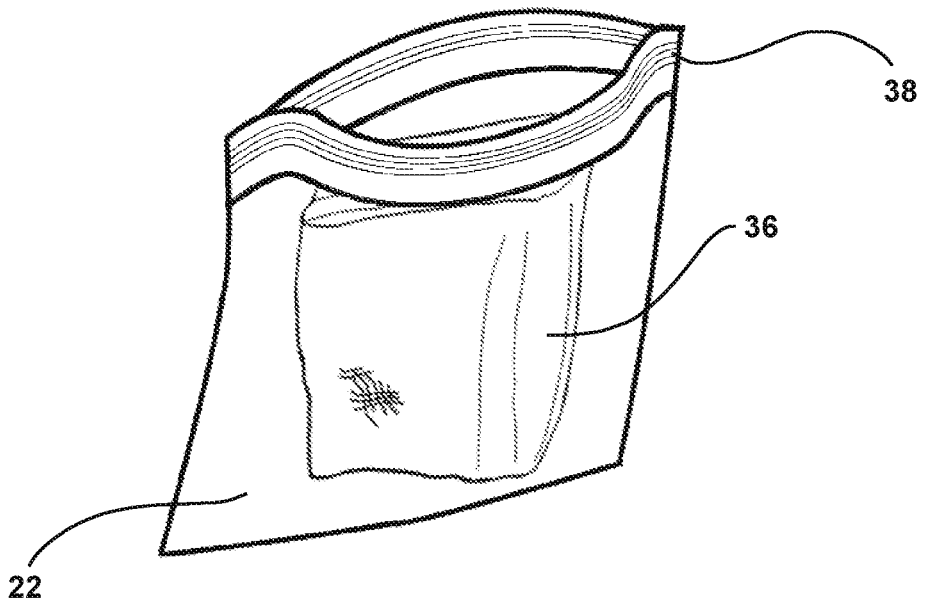
FIG. 8 is a perspective view of the zip-top bag with a garment inside.

The kit provides a wrinkle resistant dress 20 shown in FIGS. 4, 5, and 6 in a compressed carrying container 10 shown in FIGS. 1-3 and 6-7, such as a pouch, with an extra zip-top garment bag 22 shown in FIGS. 6 and 8 for emergency and portability purposes.

Factors which must be considered in the design and development of a system of the present nature include the following:

1. Potential polymeric and other interactions between the material of the storage pouch and the material of the stored garment under temperatures in excess of 100 degrees F.
2. The effect of extreme cold upon the properties of the pouch and stored garment.
3. The effect of moisture on the system.
4. The manner of closure of an opening of the pouch through which the garment to be stored is placed.
5. The geometry of the pouch.
6. Pressures and impacts to which the system may become subject.
7. Flexibility of the pouch.
8. The method of assembling the pouch.
9. Fabric chosen for construction of the dress.
10. Volume of the fabric chosen for the dress.
11. Expandability of fabric chosen for the dress.
12. Folding of the specific fabric of the dress to maximize compaction for easy insertion and minimal volume of the storage pouch.

The kit proves very valuable for convenience of storage of a dress or similar garment in a small space, for example, less than 750 cubic centimeters and an even smaller one if the article of clothing is itself smaller in volume to begin with. Common occasions for the use of such a system occur when a woman's social agenda unexpectedly changes from a business to a social or evening environment or, on occasion, where some form of damage occurs to whatever clothing or outfit she has begun the business part of her day with. For example, should one's dress be torn, stained, or soaked in moisture due to rain or other factors, the present system, preferably having a weight of no more than about 200 to about 300 grams (about 9 ounces), but up to 450 grams, and a volume of no more than 5×10×15 centimeters, can easily fit into one's handbag, a drawer of a desk at work, or the glove compartment of an automobile. With respect to travel, the risk and potential trauma of loss of one's luggage, even if for a limited period of time, can be reduced if one is able to carry within one's handbag in an or onboard travel suitcase one or more systems of the present type capable of carrying a staple article of clothing.

The pouch 10 shown in FIG. 6 is configured to require compression of the dress 20 to be inserted, thus holding the dress 20 inside in a compact positioning thereby allowing the entire kit to be placed in areas of convenience, such as a hand bag, desk drawer, vehicle glove box, and the like, for attire emergencies.

The pouch 10 comprises an interior lining 24 of moisture and heat-resistant flexible fabric adhered to an interior of said pouch, said fabric having non-reactive properties with both the material of said pouch and of said reusable compressible dress 20, as shown in FIGS. 1-8. The density of material of the pouch defines a range of about 0.25 to about 0.50 grams per square centimeter. These properties help protect the emergency dress during extended periods of storage.

The compressible dress 20 is constructed of fabric configured to resist wrinkles cause by compression for an extended period of time, wherein said fabric is in a weight range of up to 450 grams, having a thickness in the range of 0.35 mm to 0.55 mm, thereby allowing said compressible dress to be optimally folded for a reduced volume as shown in FIGS. 5 and 6. The wrinkle-resistant fabric is capable of selectable folding and compression to less than said volume of said pouch and, thereupon, press- or slip-fittable thereinto. The fabric of said compressible dress 20 is capable of expansion of at least 200% in size upon removal from said pouch, wherein said expansion does not result in a sheer or see-through material, and said fabric is capable of returning to its original physical condition after expansion.

The dress 20 is made of an elastomeric material. This material has been selected to avoid many of the problems clothing designers do not consider when creating dresses. The material must be thin enough to allow for compressibility after folding for storage and travel, but must be thick enough to avoid riding up with normal movement. It must be able to withstand extended periods of time where the dress 20 is folded, compressed, and stored without becoming wrinkled.

The dress 20 itself is a specialized dress constructed to allow maximum compressibility, but with the ability to decompress without the presence of wrinkles. The dress may be comprised of a form-fitting material that is capable of expanding by at least 200% in size.

To comport with the sizing requirements, the measurements of the dresses should exist within a limited range of measurements. As may be seen in FIG. 4, these measurements are taken with a stretched fabric. For example, a chest portion measurement 26 of the dress 10 should be in a range of about 32 inches to about 40 inches. The waist measurement 28 of the dress 20 should be about 28 inches to about 36 inches. The hip 30 measurement should be between about 34 inches to about 42 inches. The upstretched volume may be significantly lower than these dimensions to allow maximum compressability.

In addition to the sizing below, sleeves 32 of the dress 20 should be short sleeved to reduce the volume of the dress, and the length measurement 34 of the dress 20 should be knee length so that it is long enough to provide full coverage, but short enough to provide for maximized compressed volume. Thus, the length measurement 34 of the dress 20 should be in a range of about 34 inches to about 38 inches.

In order to further reduce the volume of the dress 20, the dress 20 may be selectably folded, as shown in FIGS. 5 and 6, to reduce air pockets in the pouch 10.

The system preferably uses elastomeric wrinkle-resistant fabrics in the nature of SPANDEX, which is referred to by various trademarks in various countries, these including the marks LYCRA, ELASTANE, ACEPORA, CREORA, INVIYA, ROICA, DORLASTAN, LINEL, and ESPA. However, regardless of trademark, SPANDEX is a recognized product of DuPont and, chemically, is a polyurethane-polyurea co-polymer. As the term SPANDEX suggests, it is an anagram for the word "expand".

In the context of the present invention, the interest is in articles of clothing that would be of a particular value in an emergent situation where the user finds oneself in a situation where one's regular clothing has become damaged, rendered unusable or has been lost completely as in a loss-of-luggage situation during air travel. SPANDEX is often woven in combination with other synthetic polymers to form many fabrics used in women's clothing.

SPANDEX and Lycra blends provide wrinkle-resistant properties and, as well, an absence of memory of whatever manner or extent to which it may have been compressed during storage, regardless of duration. SPANDEX/Lycra materials of this type also provide significant strength, elasticity, and, as noted, ability to return to their original shape after stretching. As well, SPANDEX will dry more quickly than other fabrics. In scientific terms, the elasticity and strength of SPANDEX has been determined to be that of a 600% elongation before rupture of the fibers thereof. Where desired, when woven it may be mixed with fibers of cotton, polyester or nylon to simulate the look or feel of such other fibers.

In a further embodiment of the invention, a fabric consisting of 90% nylon and 10% SPANDEX has been found to possess sufficient properties of elasticity and durability for use as the emergency garment in the present system.

When properly folded, a dress 20 of Lycra or a blend of nylon and SPANDEX wearable by a woman of normal size and weight can fit within a pouch 10 volume of about 750 cubic centimeters and will weigh in a range of about 200 to about 300 grams or about 9 ounces. That is, such a volume may be defined by dimensions of about 5 centimeters by 10 centimeters by 15 centimeters, equating to a pouch density of 0.33 gm per square centimeter. In practicality, these dimensions yield a small rectangular pouch 10, each having an edge 12 into which the folded, compressed dress 20 may be inserted and then sealed through the use of any of a number of closure means 14 including a zipper with a coated metal pull, or other such means include, VELCRO, straps or snaps.

It is to be understood that said volume is not absolute and may readily encompass a range of about 400 to 1000 cubic centimeters.

However, to accomplish the objects of the invention as enumerated above, it is imperative that the pouch 10 within which the dress is stored possess certain properties, namely, that it be flexible, waterproof, substantially tear-resistant and possess a high tensile strength. Clearly, the storage function of the pouch 10 must provide appropriate protection to the relatively sensitive garment material from extremes of temperature, moisture, and pressures to which the pouch may be exposed particularly during various travel conditions. It has been found that there exist various materials suitable for such an application, one of which is the DuPont product known TYVEK. TYVEK is made of fine polyethylene fibers which offer advantageous properties of paper, film polyester, and of particular fabrics. This range of properties, which cannot be found in most other available fabrics, renders TYVEK a soft structure fabric which is lightweight, yet strong, vapor permeable, and water, chemical, puncture, tear and abrasion resistant. TYVEK is smooth to the touch, does not shrink, is typically opaque and, as well, meets all requirements of the U.S. Flammable Fabrics Act that apply to wearing apparel. In other words, TYVEK, and other products in its category, are breathable as well as water resistant, durable, flexible, lightweight and tear-resistant.

Further, present-day polyesters, such as polyethylene terephthalates (PET), that are not woven can be provided with a reflective outer surface and smooth inner surface. Therefore, the pouch 10 may be formed entirely of polyester at a weight of about 50 to about 60 grams. Further, the inherent strength of the fabric of the pouch permits it to contain an article of clothing of over five times its weight.

Graphics of whatever type may also be readily printed upon TYVEX or polyester and it, as well, is stitchable. It has been found that a pouch suitable for the present application can be as light as 50 grams and is flexible to a considerable degree. Various forms of polyethylene woven fiber may also be employed in TYVEX-like fabrics. DuPont itself has competitors such as DuraFAB which produce an extensive line of tear-resistant flexible fabrics. Fabrics of this type are often referred to PTSE or polytetrafluroethyle fabrics and maintain their properties over a wide range of temperatures from minus 100 degrees Farenheit to plus 500 degrees Fahrenheit. Non-woven polyester, often referenced to as PET, and can also resist high temperatures.

An important consideration in present system is that the polyethylene or other polymeric or material of which the fabric-containing pouch is formed does not chemically react with the polyurethane-polyurea polymer of the stored garment, particularly under conditions of moisture, heat or pressure. The inventor has resolved this issue through the use of panels 16, preferably upon both sides of opposing major faces 18 of the pouch 10 by providing the faces with thin flat impact resistant internal elements. Such panels are important not only to prevent interaction between the respective polymers of the pouch and the stored garment under conditions of moisture but, as well, to provide to the garment thermal insulation as well as protection from external pressures, forces and impact. As such, the panels may have a thickness of about 2 to about 5 millimeters thus providing a high degree of protection to the stored garment. The insulative panels 16 may be selected from a group consisting essentially of neoprene, silicone, high density closed cell foams, expanded polystyrene foams, high impact polystyrene, high impact resistant corrugated cardboard treated with a flame retardant, and combinations of these materials.

However, in lieu of such panels, the PET polyester of the pouch is preferably provided with an interior lining of a thin silk-like material that is chemically inert relative to PET and PTSE, such as a carbon fiber fabric, and is moisture and heat resistant.

The opening or closure of a suitable edge of the pouch may be accomplished through the use of a zipper, VELCRO flaps or snaps. See FIG. 1 in which the use of a zipper is shown.

Also included in the kit is a reclosable sealable plastic zip-top bag 22 for receiving soiled garments, shown in FIG. 8, separate from that of said pouch 10. The reclosable sealable plastic zip-top bag 22 allows the dress-wearer to store and temporarily seal any soiled clothing without soiling the pouch. For instance, if the dress-wearer had fallen in mud, the dress would not only be soiled, but would be moist, and may possibly have an odor. The bag includes a zip-top closure 38 to seal the contents therein. By sealing the garment 36 in the resealable plastic zip-top bag 22, a dress-wearer may continue on with her day until she has time to take care of the soiled dress without also soiling the pouch 10 of the emergency dress 20.

The invention also includes a method for providing a kit for compact storage and maximum portability of a reusable compressible dress intended for emergency use, with the steps of: 1) providing a pouch 10 wherein said pouch 10 is selected from a material having a flexible, waterproof, tear-resistant material having a volume in the range of 400 to 1000 cubic centimeters, the pouch 10 including means for selectable opening and closure 14 of a longitudinal opening thereof, 2) providing a compressible dress 20, wherein said providing of said compressible dress further includes constructing said dress of fabric configured to resist wrinkles cause by compression for an extended period of time, wherein said fabric is in a weight range of up to 450 grams, having a thickness in the range of 0.35 mm to 0.55 mm, thereby allowing said compressible dress to be optimally folded for a reduced volume, wherein said wrinkle-resistant fabric is capable of selectable folding and compression to less than said volume of said pouch 10 and, thereupon, press- or slip-fittable thereinto, and said fabric of said compressible dress 20 is capable of expansion of at least 200% in size upon removal from said pouch 10, wherein said expansion does not result in a sheer or see-through material, and said fabric is capable of returning to its original physical condition after expansion, 3) folding and including a reclosable sealable plastic zip-top bag 22 inside said pouch 10 for receiving soiled garments 36, separate from that of said pouch 10, 4) folding said compressible dress 20 into segments that mirror width 40 and length 42 dimensions of said pouch 10, as shown in FIG. 6, to avoid gaps and air pockets between the compressible dress 20 and pouch 10 when said dress 20 is slipped into said pouch 10, and 5) inserting said compressed dress 20 into said longitudinal opening.

Further steps which may be employed with this method include: 1) including interior lining 24 of moisture and heat-resistant flexible fabric adhered to an interior of said pouch 10, said fabric having non-reactive properties with both the material of said pouch and of said reusable compressible dress 20, 2) configuring a density of material of said pouch 10 to define a range of about 0.25 to about 0.50 grams per square centimeter, 3) configuring a waist measurement 28 of said dress define a range of twenty eight inches to thirty six inches, 4) configuring a chest measurement 26 of said dress 20 define a range of thirty two inches to forty inches, 5) configuring a hip measurement 30 of said dress 20 define a range of thirty four inches to forty two inches, 6) configuring a length measurement 34 of said dress 20 define a range of thirty four inches to thirty eight inches, and 7) configuring the dress 20 to be short-sleeved to minimize excess fabric.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A kit for compact storage and maximum portability of a reusable compressible dress intended for emergency use, the kit comprising:

a pouch formed of a flexible, waterproof, tear-resistant material having a volume in the range of 400 to 1000 cubic centimeters, the pouch including means for selectable opening and closure of a longitudinal opening thereof;

a compressible dress, constructed of fabric configured to resist wrinkles cause by compression for an extended period of time, wherein said fabric is in a weight range of up to 450 grams, having a thickness in the range of 0.35 mm to 0.55 mm, thereby allowing said compressible dress to be optimally folded for a reduced volume;

said wrinkle-resistant fabric capable of selectable folding and compression to less than said volume of said pouch and, thereupon, press- or slip-fittable thereinto;

said fabric of said compressible dress is capable of expansion of at least 200% in size upon removal from said pouch, wherein said expansion does not result in a sheer or see-through material, and said fabric is capable of returning to its original physical condition after expansion; and a reclosable sealable plastic zip-top bag for receiving soiled garments, separate from that of said pouch.

2. The kit as recited in claim 1, wherein the pouch further comprises an interior lining of moisture and heat-resistant flexible fabric adhered to an interior of said pouch, said fabric having non-reactive properties with both the material of said pouch and of said reusable compressible dress.

3. The kit as recited in claim 1, in which a density of material of said pouch defines a range of about 0.25 to about 0.50 grams per square centimeter.

4. The kit as recited in claim 1, wherein a waist measurement of said dress define a range of twenty eight inches to thirty six inches, a chest measurement of said dress define a range of thirty two inches to forty inches, a hip measurement of said dress define a range of thirty four inches to forty two inches, and a length measurement of said dress define a range of thirty four inches to thirty eight inches.

5. The kit as recited in claim 4, wherein the dress is configured to be short-sleeved to minimize excess fabric.

6. A method for providing a kit for compact storage and maximum portability of a reusable compressible dress intended for emergency use, the method comprising:

providing a pouch wherein said pouch is selected from a material having a flexible, waterproof, tear-resistant material having a volume in the range of 400 to 1000 cubic centimeters, the pouch including means for selectable opening and closure of a longitudinal opening thereof;

providing a compressible dress, wherein said providing of said compressible dress further includes constructing said dress of fabric configured to resist wrinkles cause by compression for an extended period of time, wherein said fabric is in a weight range of up to 450 grams, having a thickness in the range of 0.35 mm to 0.55 mm, thereby allowing said compressible dress to be optimally folded for a reduced volume, wherein said wrinkle-resistant fabric is capable of selectable folding and compression to less than said volume of said pouch and, thereupon, press- or slip-fittable thereinto, and said fabric of said compressible dress is capable of expansion of at least 200% in size upon removal from said pouch, wherein said expansion does not result in a sheer or see-through material, and said fabric is capable of returning to its original physical condition after expansion;

folding and including a reclosable sealable plastic zip-top bag inside said pouch for receiving soiled garments, separate from that of said pouch;

folding said compressible dress into segments that mirror width and length dimensions of said pouch to avoid gaps and air pockets between the compressible dress and pouch when said dress is slipped into said pouch; and inserting said compressed dress into said longitudinal opening.

7. The method of claim 6, further comprising:

including interior lining of moisture and heat-resistant flexible fabric adhered to an interior of said pouch, said fabric having non-reactive properties with both the material of said pouch and of said reusable compressible dress.

8. The method as recited in claim 6, further comprising:

configuring a density of material of said pouch to define a range of about 0.25 to about 0.50 grams per square centimeter.

9. The method as recited in claim 6, further comprising:

configuring a waist measurement of said dress define a range of twenty eight inches to thirty six inches;

configuring a chest measurement of said dress define a range of thirty two inches to forty inches;

configuring a hip measurement of said dress define a range of thirty four inches to forty two inches; and configuring a length measurement of said dress define a range of thirty four inches to thirty eight inches.

10. The kit as recited in claim 9, further comprising:

configuring the dress to be short-sleeved to minimize excess fabric.

* * * * *